United States Patent [19]

Skinner

[11] 4,202,191

[45] May 13, 1980

[54] FAULT DETECTOR

[75] Inventor: Edward A. Skinner, Welwyn Garden City, England

[73] Assignee: Avdel Limited, Hertfordshire, England

[21] Appl. No.: 880,707

[22] Filed: Feb. 23, 1978

[30] Foreign Application Priority Data

Feb. 25, 1977 [GB] United Kingdom ..... 8106/77

[51] Int. Cl.[2] ..... B21B 37/00

[52] U.S. Cl. ..... 72/10; 72/3; 72/354

[58] Field of Search ..... 72/3, 4, 21, 22, 26, 72/10, 354

[56] References Cited

U.S. PATENT DOCUMENTS

| | | | |
|---|---|---|---|
| 1,910,681 | 5/1933 | Dickson | 72/10 |
| 1,916,379 | 7/1933 | Leland | 72/3 |
| 2,134,933 | 11/1938 | Smith | 72/3 |
| 2,339,773 | 1/1944 | Egan | 252/134 |
| 2,643,403 | 6/1953 | MacBlane et al. | 10/72 |
| 2,681,026 | 6/1954 | Zajic | 72/4 |
| 2,732,738 | 1/1956 | Krause | 72/25 |
| 2,821,251 | 1/1958 | Borke | 72/10 |
| 3,162,873 | 12/1964 | Ohme | 10/129 R |
| 3,280,613 | 10/1966 | Schrom | 72/26 X |
| 3,339,434 | 9/1967 | Sparling | 408/7 |
| 3,440,909 | 4/1969 | Schmid et al. | 83/61 |
| 3,747,142 | 7/1973 | Arbogast et al. | 10/7 |

*Primary Examiner*—Leon Gilden

*Attorney, Agent, or Firm*—Oblon, Fisher, Spivak, McClelland & Maier

[57] ABSTRACT

A cold forging machine comprises a fixed die 11 and a movable punch tool 13 reciprocable towards and away from the fixed die to act on a workpiece therein. The tool comprises a tubular punch 34 and extrusion pin 33 movable through the punch to form a bore in the workpiece. The die is provided with a tubular ejector 15 in which slides a carrier pin 16 to enter the bore of the formed workpiece to guide it during ejection. A fault detection system includes a switch 25,61 for detecting non-completion of the normal movement of the carrier pin 16 with respect to the ejector 15, and a further switch for detecting non-completion of normal movement of the extrusion pin 33 with respect to the punch 34.

10 Claims, 12 Drawing Figures

FAULT DETECTOR

The invention relates to a fault detector for use with a metal forming machine, and more particularly for use with a cold forging machine used to manufacture tubular articles, i.e. articles each having a bore completely through it, for example tubular rivets.

Such a machine essentially comprises a fixed die in which a workpiece is received, and a movable tool reciprocable towards and away from the die to operate on the workpiece. Commonly the machine includes a plurality of die and tool stations, workpieces being moved successively from one station to the next, and the machine operating in continuously repeating cycles, often at high speed.

In particular the invention is intended for use with such a machine in which the movable tool (or one of them) includes a pin which enters into a tubular workpiece which is then compressed around the pin. A fault can occur in such an operation, for example because the part of the pin inside the compressed workpiece breaks off and stays inside the tubular workpiece. Alternatively the workpiece may be firmly swaged onto the pin, so that when the pin is withdrawn from the die the engagement of the workpiece on the pin is so secure as to resist the action of the stripper. In either event, damage to the tooling of the machine will occur in the next cycle of the machine.

Thus the invention is applicable to a metal-forming machine for producing a tubular workpiece and having a fixed die which receives the workpiece and a movable tool reciprocable in repeated cycles and movable towards the die to act on the workpiece and retractable away from the die to provide for removal of the workpiece from the die, and in which the movable tool includes a metal-forming pin which is first advanced towards the die and into the workpiece which is then compressed around the pin, and subsequently retracted from the die in a direction opposite to the said direction of advance to provide for removal of the workpiece therefrom. Such a machine is hereinafter referred to as "a machine of the type defined".

The invention provides, in one of its aspects, in or for a metal-forming machine for producing a tubular workpiece and having a fixed die which receives the workpiece and a movable tool reciprocable in repeated cycles and movable towards the die to act on the workpiece and retractable away from the die to provide for removal of the workpiece from the die and in which the movable tool includes a metal-forming pin which is first advanced towards the die and into the workpiece which is then compressed around the metal-forming pin, and subsequently retracted from the die in a direction opposite to the said direction of advance to provide for removal of the workpiece therefrom: a fault detector which comprises:

a detector pin normally movable through the bore of the tubular workpiece, after the completion of the compression process, in the direction of retraction of the metal-forming pin; and fault indicating means responsive to completion or non-completion of normal movement of the detector pin for producing a signal indicating a fault if the detector pin has not moved normally through the workpiece bore as aforesaid.

In one manner of putting the invention into practice, the detector pin is located behind and/or within the die and is normally movable through the bore of the tubular workpiece as aforesaid by movement into and/or through the die.

In another manner of putting the invention into practice, the detector pin is provided by the aforesaid metal-forming pin, the pin being normally movable through the bore of the tubular workpiece as aforesaid by relative movement between the pin and another part of the movable tool abutting the workpiece.

In a preferred embodiment of the invention, the fault detector includes a first detector pin located behind and/or within the die and normally movable through the bore of the tubular workpiece as aforesaid by movement into and/or through the die, and second detector pin provided by the aforesaid metal-forming pin which is normally movable through the bore of the tubular workpiece as aforesaid by relative movement between the pin and another part of the movable tool abutting the workpiece.

The detector pin or the first detector pin may be provided by a guide pin which guides the workpiece during its removal from the die.

The said other part of the tool may be a punch and/or stripper surrounding the pin.

Preferably normal movement of the or each detector pin is completed before the start of removal of the workpiece from the die.

In a preferred embodiment of the invention, said fault indicating means responsive to completion or non-completion of normal movement of the or each detector pin comprises:

first means for producing a first signal in response to completion of the normal movement of the or each detector pin;

second means for retaining an indication of said first signal at least for a predetermined part of the retraction of the tool;

and third means for reading the said retained indication at a predetermined point within said predetermined part of the retraction of the tool.

Where the machine of the type defined includes an ejector for ejecting the tubular workpiece from the die after completion of the compression process, the fault detector may be such that the aforesaid predetermined reading point at which the signal is read is before the start of ejection of the workpiece.

Preferably the aforesaid predetermined point at which the signal is read is such that the extent of the part of the retraction of the tool which elapses between the end of normal movement of the detector pin through the tubular workpiece and the aforesaid predetermined reading point is substantially less than the extent of the part of the retraction of the tool which elapses between the aforesaid predetermined reading point and the start of ejection of the workpiece.

A specific embodiment of the invention will now be described by way of example and with reference to the accompanying drawings, in which.

The machine of this example is a multi-stage cold-heading machine commercially available the designation Malmedie H530. FIGS. 1 to 8 all refer to the same stage or tool/die station on the machine. The machine of this example is set up for manufacturing tubular rivets.

Figure 1:
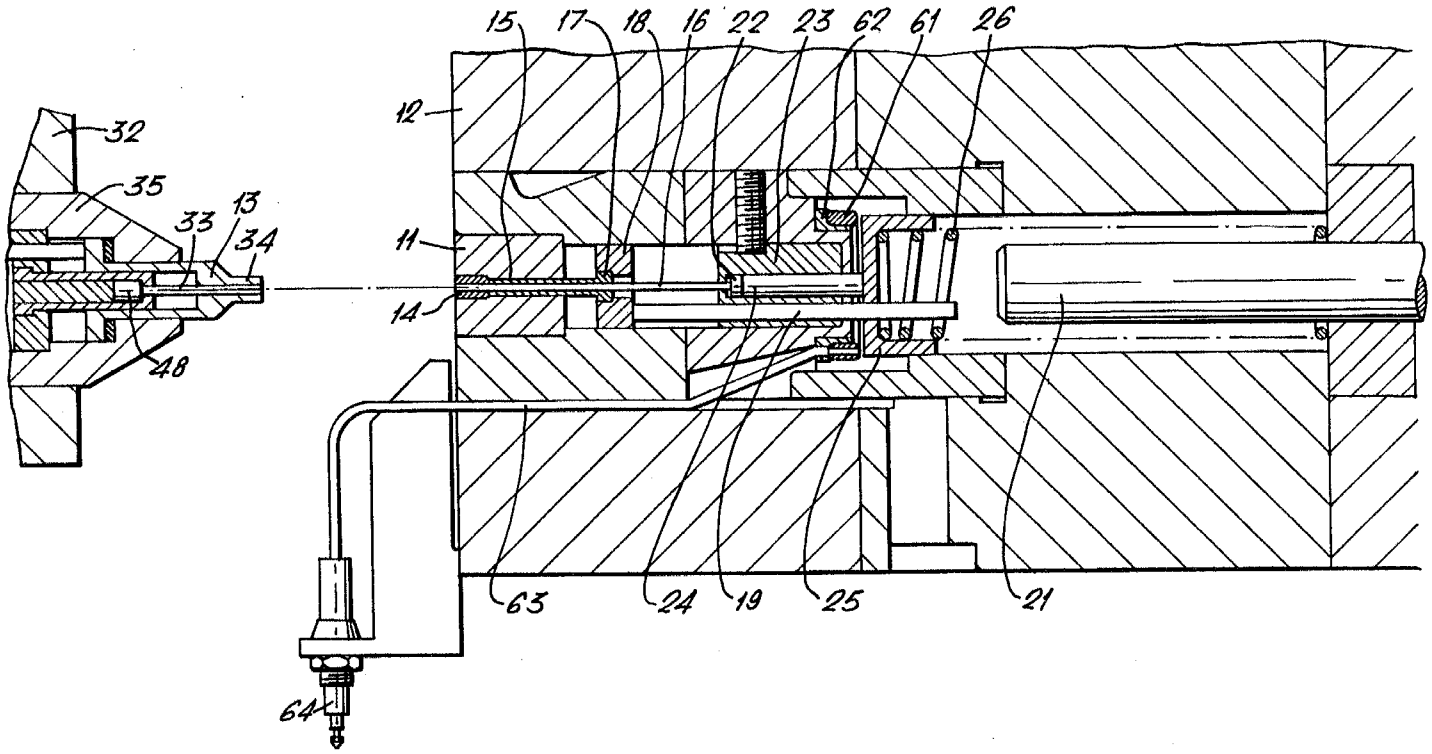
FIGS. 1 to 4 are sections through a die and movable tool of a machine and illustrate successive positions in the operation of the die and its fault indicating means.
Figure 2:
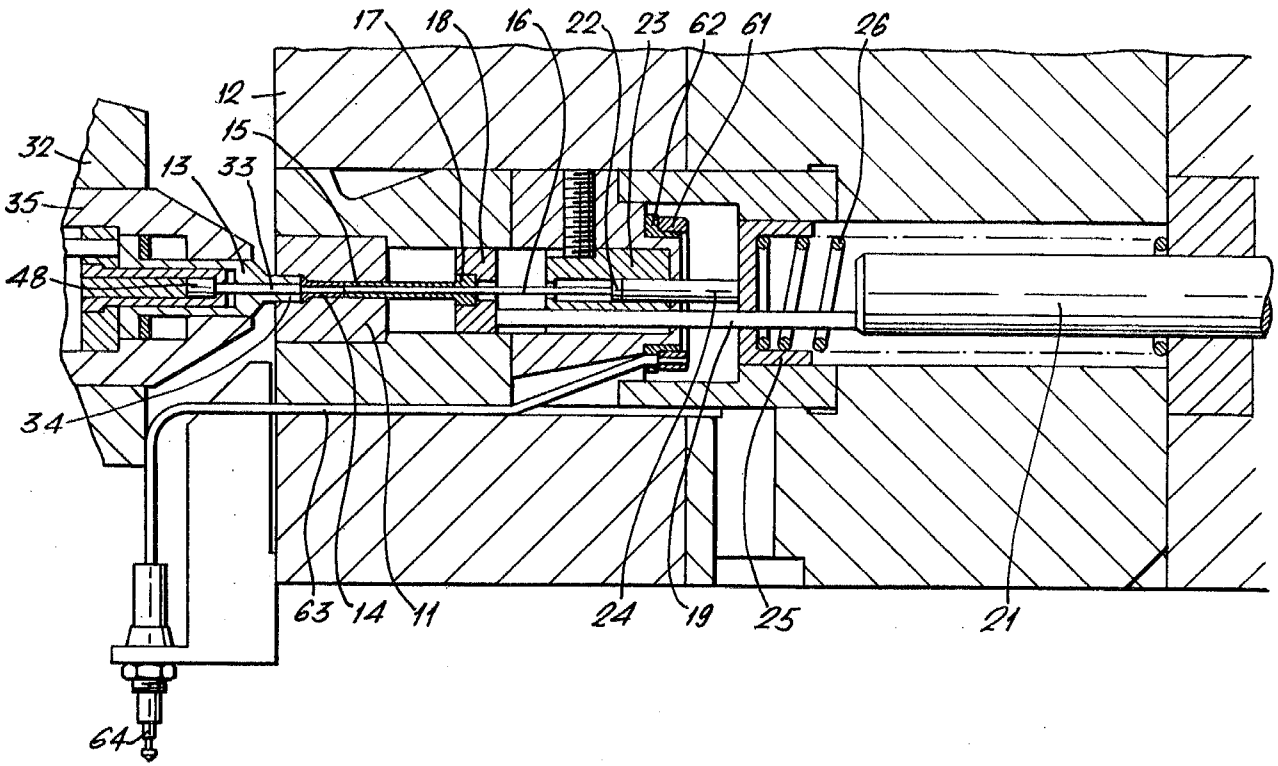
Figure 3:
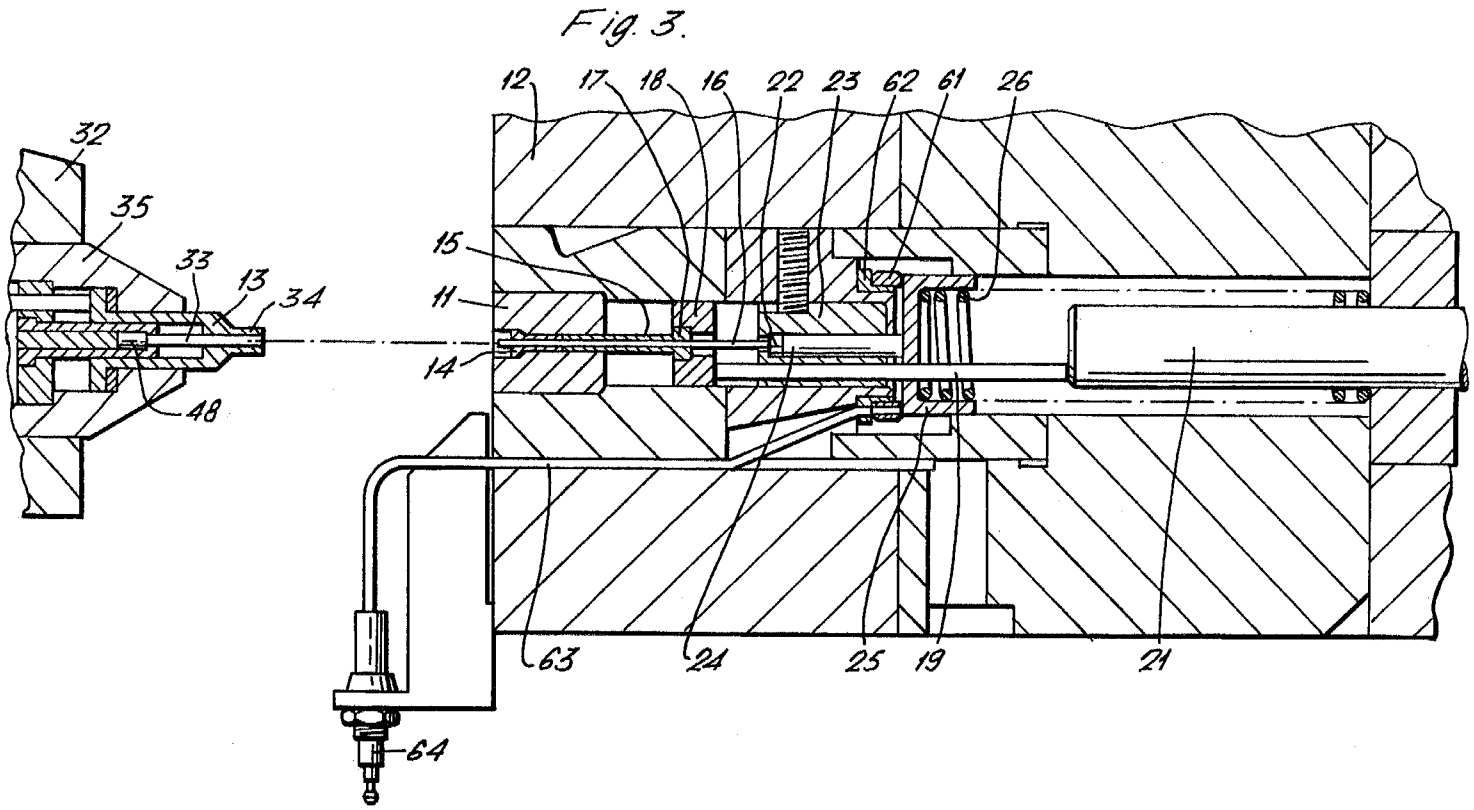
Figure 5:
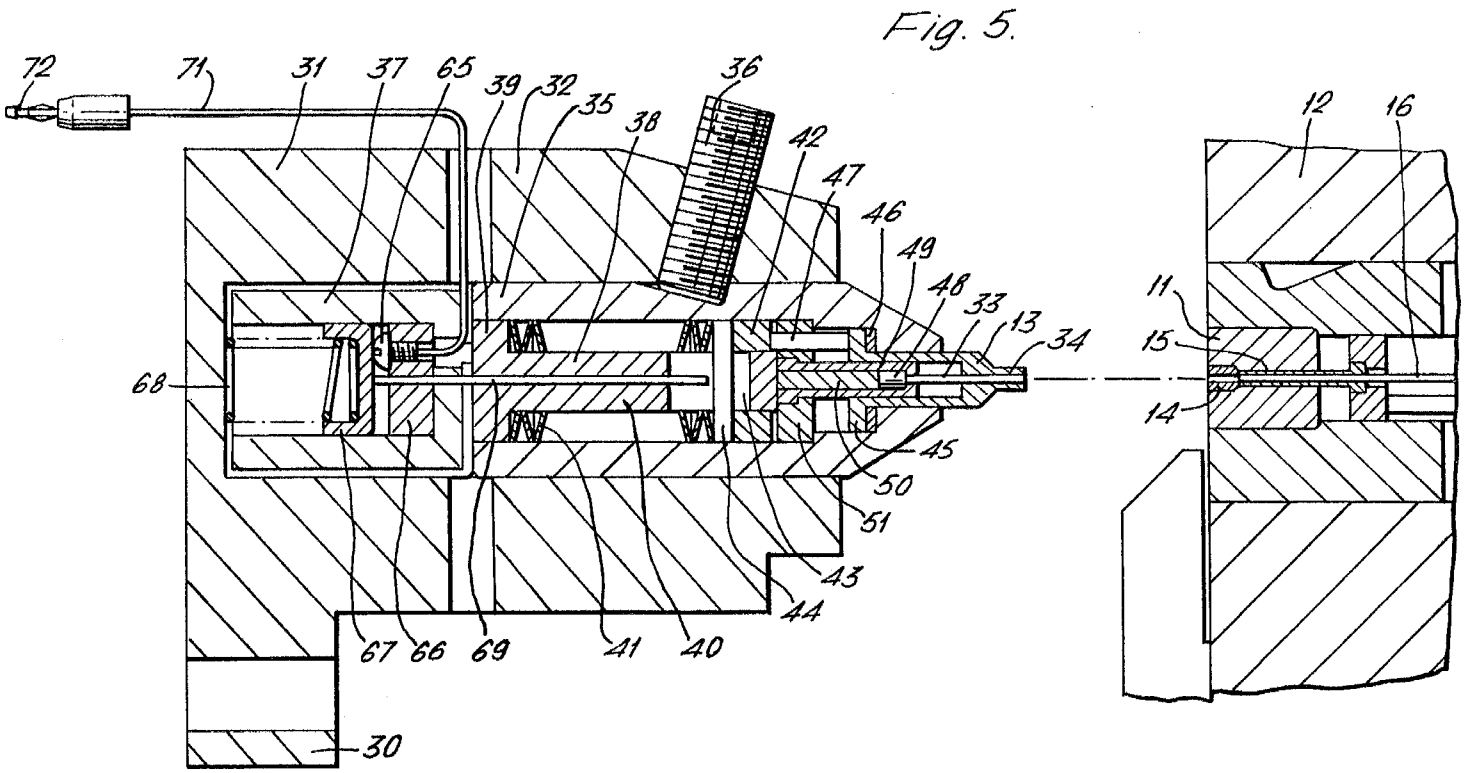
FIGS. 5 to 8 are sections through the same die and movable tool and illustrate successive positions in the operation of the movable tool and its fault indicating means.

Referring first to FIGS. 1 and 5, this stage of the machine comprises essentially a fixed die 11 mounted in a fixed part of the machine frame 12, and a movable tool 13 reciprocable in repeated cycles and movable towards the die to act on a tubular workpiece 14 received in the die and retractable away from the die to provide for removal of the workpiece. Removal is achieved by means of an ejector 15, a guide on a carrier pin 16 and a pairof transfer fingers (not shown). For the purpose of clarity of illustration, the workpiece is shown already received in the die in FIGS. 1 and 5 with the tool still approaching, although in practice the workpiece would be held by the transfer fingers until inserted into the die by the advancing tool. The ejector 15 is tubular so that the carrier pin 16 can slide inside it. The rear end 17 of the ejector is seated in a sliding bush 18 which is urged forwardly (i.e. towards the die) by three pushrods, one of which is shown at 19, equally spaced circumferentially of the bush 18. The rear end of each pushrod 19 is (in the position illustrated in FIG. 1) spaced a short distance away from an ejector plunger 21 which is actuated from the main machine crankshaft to move the ejector 15 forward at the correct time and by the correct distance to eject the workpiece from the die. The space between the pushrods 19 and the ejector plunger 21 accommodates rearward movement of the ejector 15 when the workpiece is extruded and elongated as illustrated in FIG. 2. When the workpiece is ejected it is again picked up by the transfer fingers (not shown) and is supported and guided by the carrier pin 16. The enlarged rear end 22 of the carrier pin slides inside a bush 23 and is urged forwardly (i.e. towards the die) by a filler pin 24 in contact with a spring-follower cup 25 which in turn is urged forwardly by a spring 26. The bush 23 is fixed in position so that the forwardmost position of the carrier pin under the urging of the spring 26 is as illustrated in FIGS. 1, 2 and 3 with the front end of the pin within the cavity of the die 11 and not far inside its mouth. The carrier pin can be forced rearwardly against the urging of spring 26.

Figure 7:
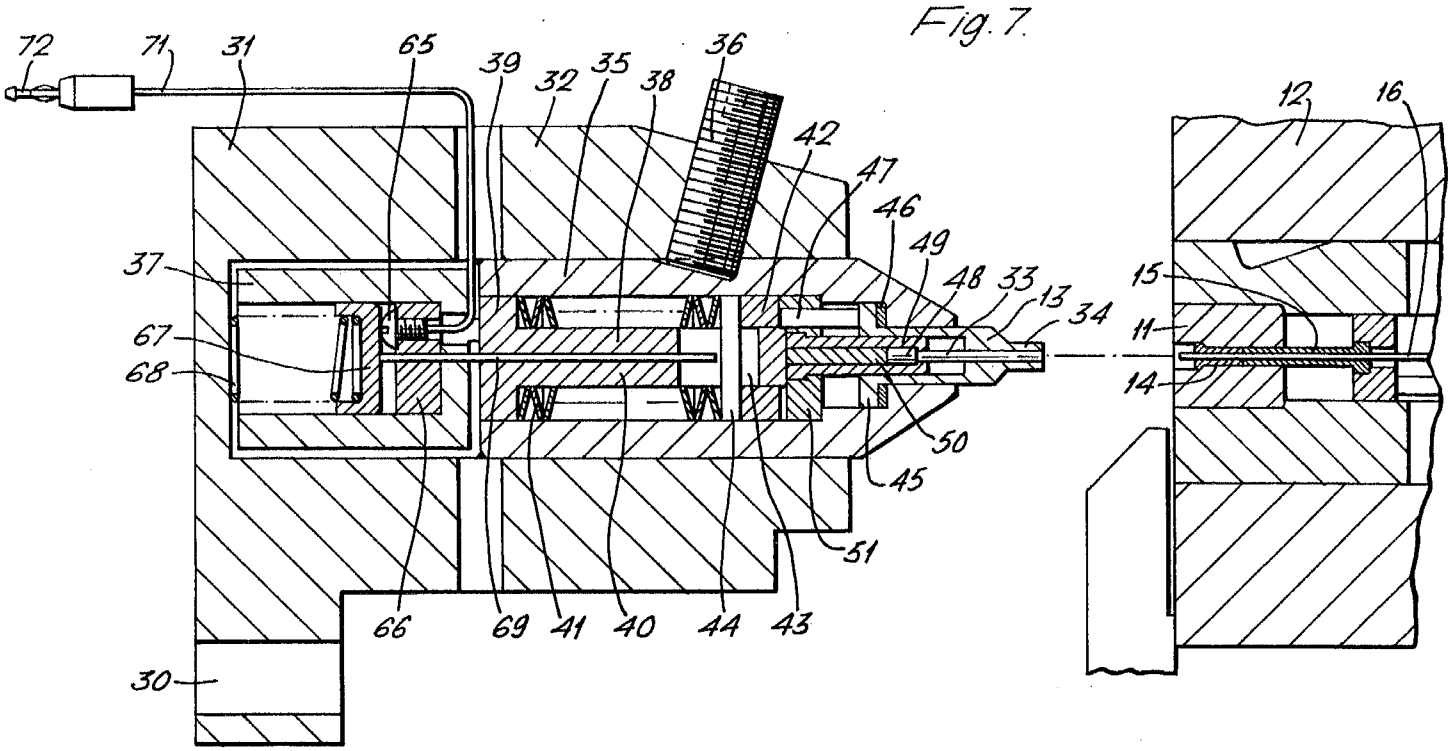

The movable tool arrangement is shown more particularly in FIG. 5. The movable tool side of the stage is known in the art as the "ram side" in distinction to the fixed side of the stage which is known in the art as the "die side". The tool arrangement is mounted in a tool housing 32 which forms the front end part of a main ram 31. The ram 31 is reciprocable by means of a crank driven from the main machine crankshaft. The tool 13 comprises two parts, an extrusion pin 33 mounted solid with the ram and a punch 34 concentric about the pin 33. The punch is mounted for sliding movement over a restricted distance relative to the pin, under the forwards (i.e. towards the die) urging of a relatively strong spring. In its forward position, the forward end of the punch 34 is level with the forward end of the pin 33, as shown in FIGS. 5 and 7. The pin 33 and punch 34 are mounted in a sleeve 35 secured within the housing 32 by a screw 36. The rear end of the sleeve 35 abuts the front of a tubular plug 37 the rear end of which abuts the front end of the ram 31. The rear part of the sleeve 35 contains a filler 38, the rearmost part 39 of which also abuts the front of the plug 37. The major part of the length of the filler 38 is a shank 40 reduced in diameter to provide an annular space which accommodates a Belleville spring pack 41. The rear end of the spring 41 abuts the part 39 of the filler 38, while the front end abuts the rear face of a grooved collar 42 which can slide on the filler shank 40. The filler shank 40 has a cross-slot 43 adjacent but spaced from its front end, in which rides a rectangular-section cross-pin or blade 44. This blade is received in a diametral groove across the rear face of the grooved collar 42.

The rear end of the punch 34 is enlarged into a flange 45 which carries a washer 46 on its front face to abut the front end inner face of the sleeve 35. The rear of the punch flange 45 is spaced from the front of the collar 42 by three pushrods or pins spaced apart equally circumferentially of the flange and one of which is indicated at 47.

The rear end of the extrusion pin 33 is enlarged into a head 48 which is held within the front end of a tubular sleeve 49, the rear end of the sleeve abutting the front end of the filler shank 40, and being kept in position by a collar 51 within the sleeve 35 and having these apertures through which pass the three pins 47. A filler pin 50 within the sleeve 49 extends between the front end of filler shank 40 and the rear end of the extrusion pin head 48.

Figure 6:
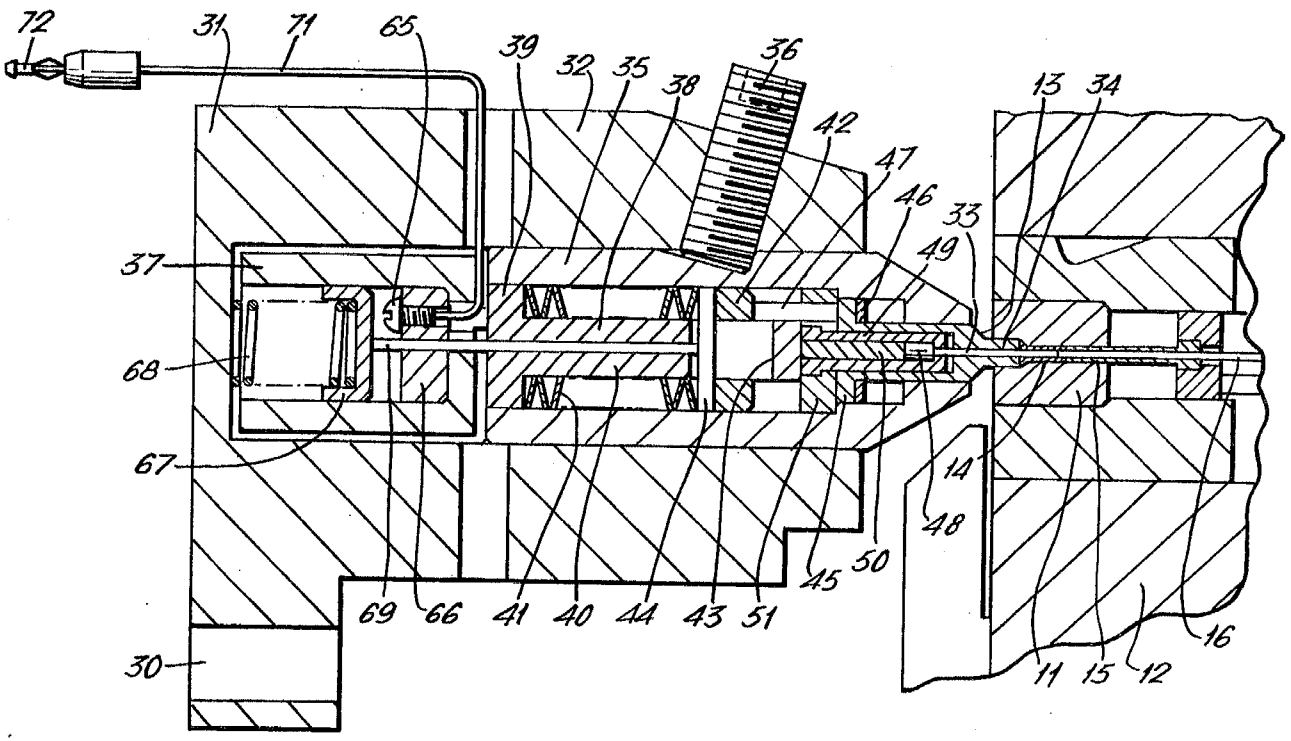
Figure 8:
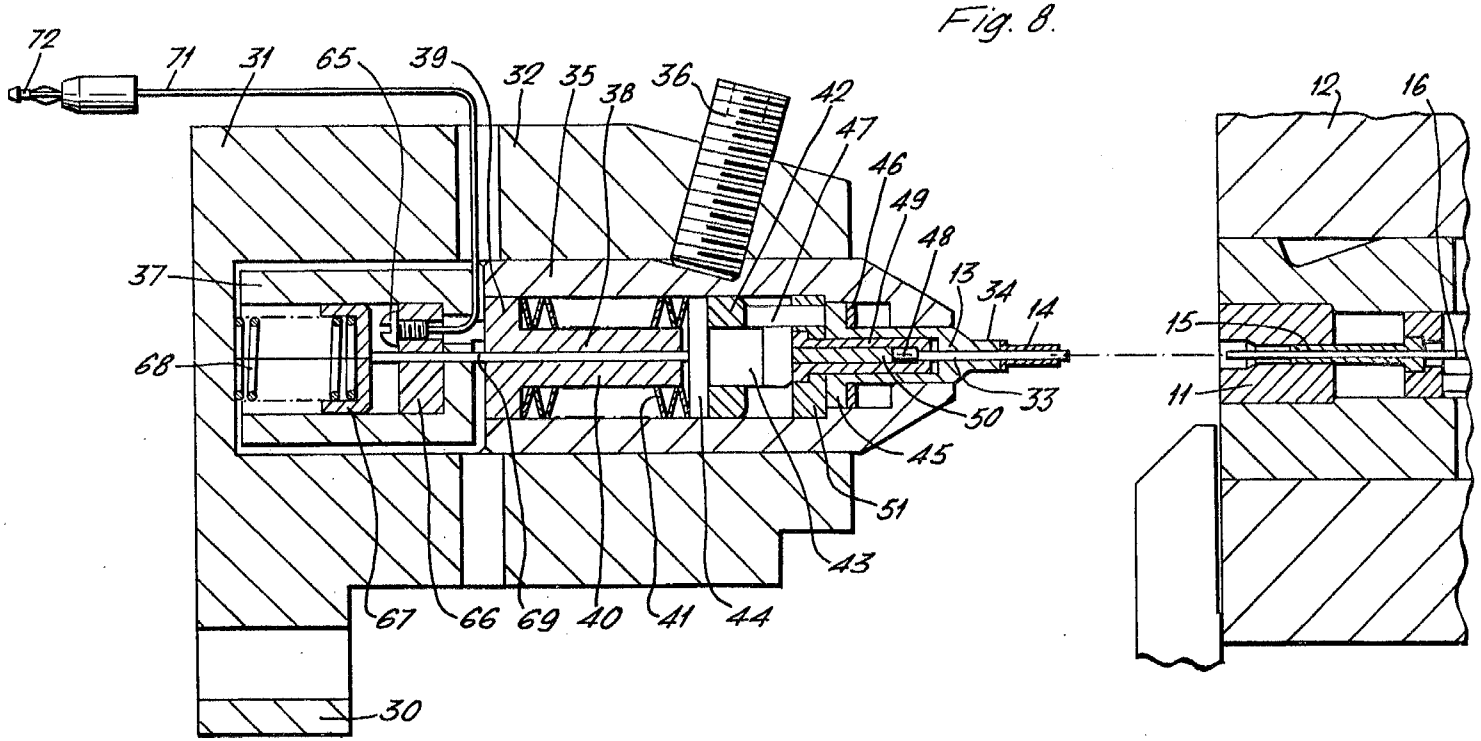

It will be apparent from the above-described construction that the extrusion pin 33 is held solid with the ram 31, whereas the punch 34 has limited sliding axial movement, under the forwards urging of the relatively strong Belleville spring 41, between a forwards position as illustrated in FIGS. 5 and 7 in which the front of the punch is level with the front of the extrusion pin 33, and a rearwards position as illustrated in FIGS. 6 and 8 in which the Belleville spring 41 is compressed and the rear flange 45 of the punch abuts the collar 51 which in turn is supported by the rear end of tubular sleeve 49 abutting the end of the filler 38.

The normal operation of this stage of the machine will now be described, with reference to FIGS. 1 to 3, 5 to 7, and 10 and 11.

Figure 9:
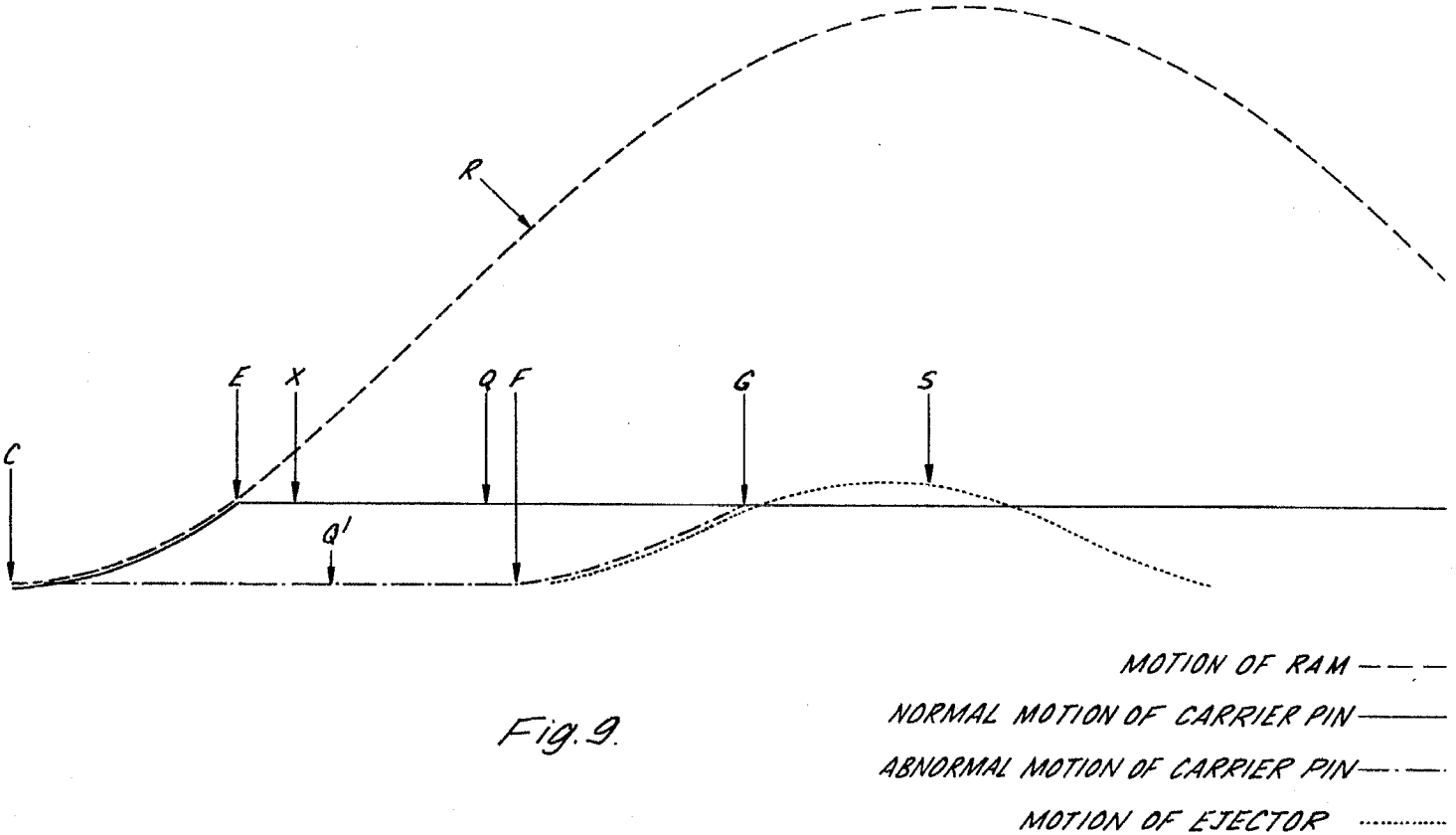
FIGS. 9 and 10 illustrate graphically the cycle of operation of the machine and, respectively, the operation of the die-side, and of the tool-side or ram-side, fault detector means.
Figure 10:
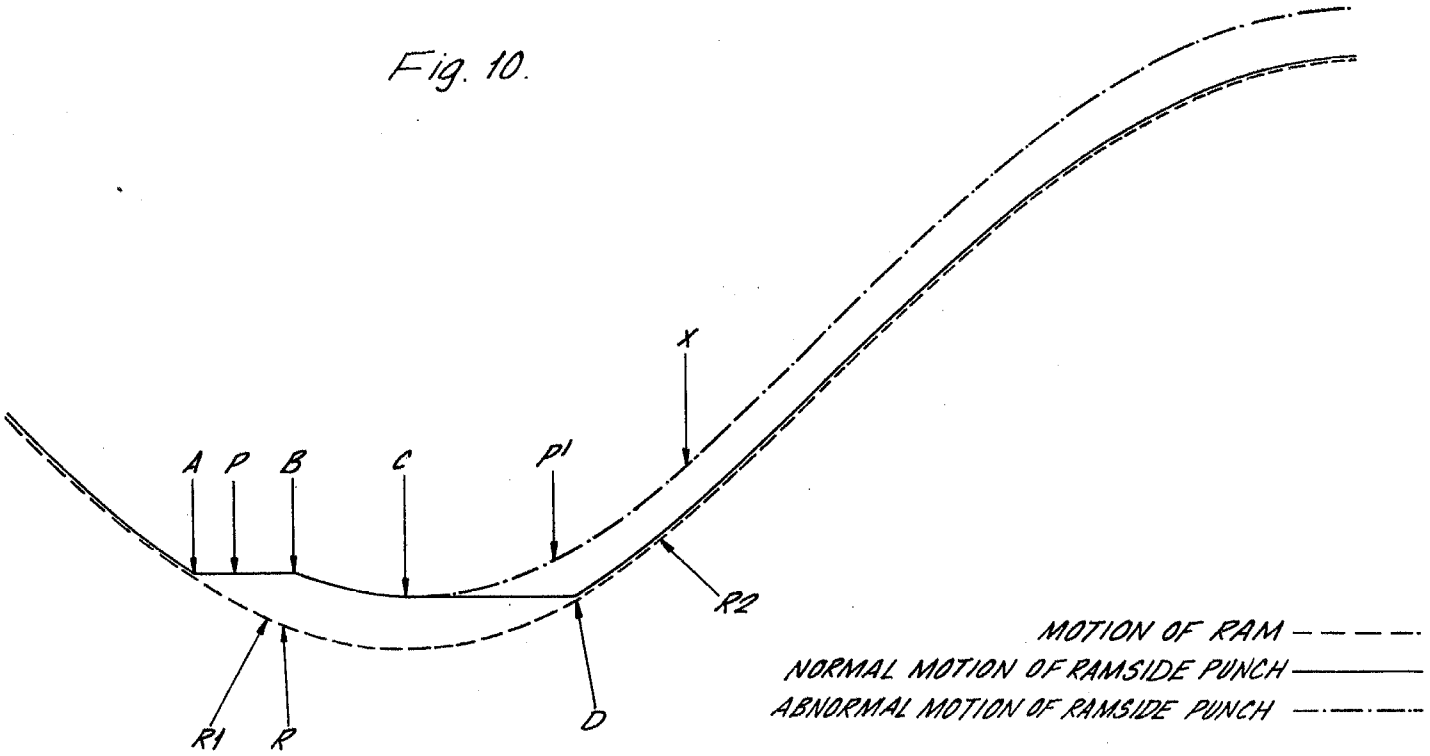

FIGS. 9 and 10 illustrate graphically the relative movement of the ram 31 and the extrusion pin 33 which is solid with it (broken line R), of the punch 34 (solid line P), of the carrier pin 16 (solid line Q), and of the ejector 15 (dotted line S). For the clarity of illustration, FIG. 10 shows the motion of the ram 31 and punch 34, while FIG. 9 shows seperately the motion of the ram 31, carrier pin 16 and ejector 15. In both FIGS. 9 and 10, movement of the ram and other parts is represented as vertical displacement, and elapse of time (or progressive movement through the cycle of operation of the machine) by displacement from left to right.

FIGS. 1 and 5 show the ram advancing the tool towards the die. As already explained, FIGS. 1 and 5 show the workpiece already received in the die, whereas in practice it would be pushed into the die by the advancing tool. However, this makes no difference to this explanation of the operation of the ram and tool.

The tool advances (represented by the part R1 of curve R in FIG. 10) with the punch 34 level with the extrusion pin 33 until the punch 34 meets the resistance of the workpiece 14 in the die 11. This is represented by point A in FIG. 10. The pin 33 enters into the bore in the tubular workpiece and continues to advance, pushing the carrier pin 16 back against the urging of its spring 26. However the punch is held by the workpiece and remains level with the outer face of the die (represented by the part A-B of Line P in FIG. 10). It is thus displaced rearwardly with respect to the advancing ram, compressing the Belleville spring pack 41 which exerts an increasing force on the punch. Eventually the punch 45 abuts the collar 51 (represented by the point B in FIG. 10) and the punch is driven forwards once more (represented by the part B-C of Line P in FIG. 10). This compresses the workpiece about the extrusion pin 33 which is by this time extending throughout and beyond the workpiece bore, and extrudes the workpiece further into the die and over the extrusion pin, pushing back the ejector 15 to take up the lost motion between pushrods 19 and ejector plunger 21. At point C in FIGS. 9 and 10 the ram reaches forward dead centre, which is the position shown in FIGS. 2 and 8.

The ram then starts to retract, retracting the extrusion pin 33 with it. Initially the punch 34 will dwell in contact with the workpiece within the die, under the urging of the spring 41, as represented by the section C-D of line P in FIG. 10. The punch thus also acts as a stripper to remove the workpiece from the retracting extrusion pin. However when the front end of the extrusion pin 33 has retracted to level with the front end of the punch 34 (represented by the point D in FIG. 10) the flange 45 of the punch is picked up by the washer 46 inside the front end of the tool sleeve 35, and the punch then continues to retract with the ram (represented by the part R2 of curve R in FIGS. 9 and 10.

As the ram 31 and extrusion pin 33 start to retract, the carrier pin 16 (which is in contact with the extrusion pin 33) starts to advance into and through the die, i.e. into the bore in the workpiece 14, under the urging of spring 26. This movement is represented by the part C-E of curve Q in FIG. 9. However advance of the carrier pin is limited by abutment of its enlarged rear end 22 with the front end of bush 23, and the carrier pin 16 therefore stops (represented by point E in FIG. 9) and remains in that position (represented by the straight line portion of curve Q in FIG. 9).

The ram 31 continues to retract away from the die and workpiece. When retraction has proceeded until the tool is well clear of the die, as illustrated in FIGS. 3 and 7, the ejector plunger 21 moves forward (represented by the portion F-G of curve S in FIG. 9) and forces the ejector 15 forwards to eject the workpiece from the die, during which the workpiece is guided by the carrier pin 16, until it is picked up by the transfer fingers (not shown). The ejector plunger then retracts, but the ejector sleeve 15 will remain advanced in the position shown in FIG. 1, until forced back by the extrusion of the next succeeding workpiece in the cycle of operation of the machine.

The construction and operation of the machine as this far described is believed to be conventional and well known in the art of cold forging of tubular metal objects such as small rivets.

Figure 4:
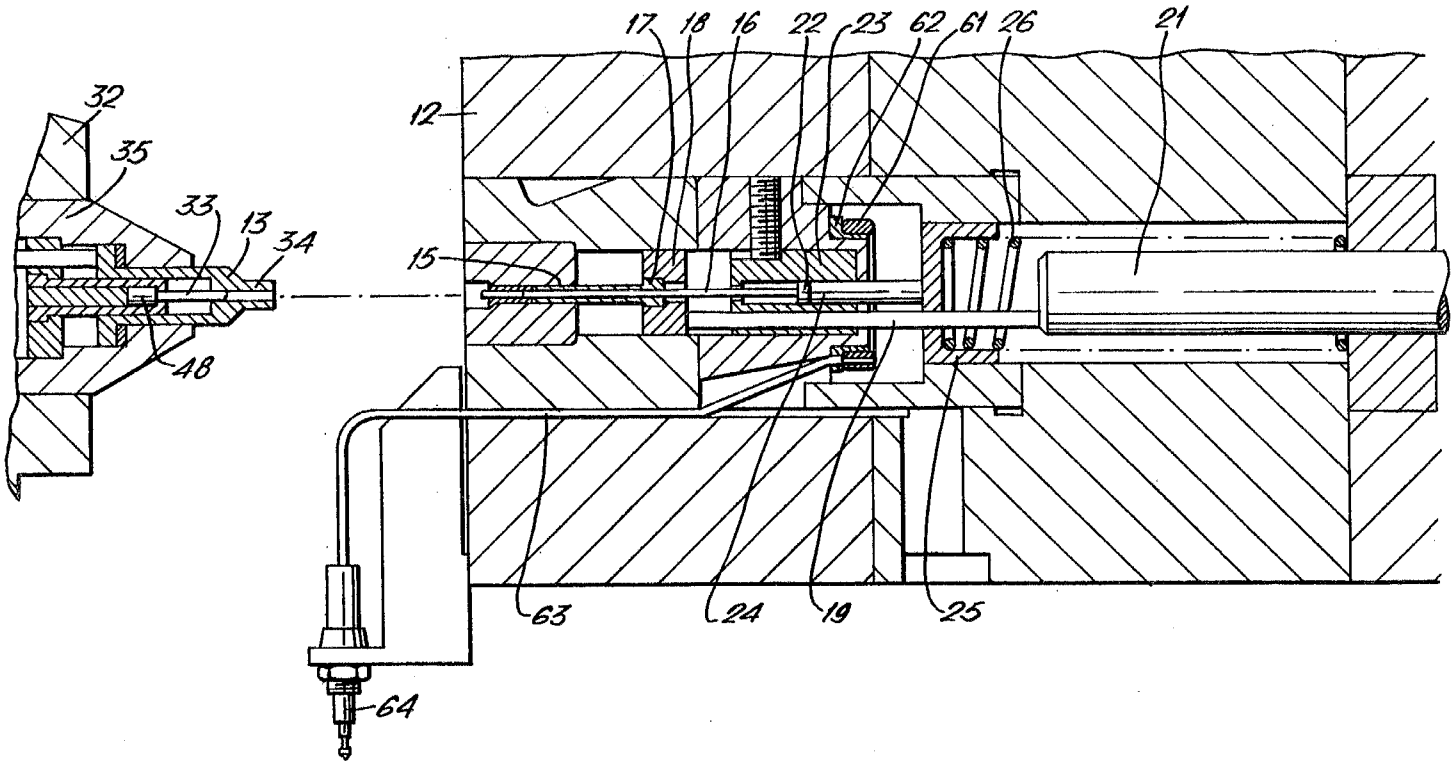

As previously mentioned, faults can occur in such a machine stage due to the fact that the workpiece 14 is compressed very strongly on to the front end of the extrusion pin 33. Two fault conditions may then occur. The tip of the extrusion pin 33 may break off and remain in the workpiece which itself remains wedged in the die 11. This condition is illustrated in FIG. 4. Alternatively the extruded workpiece 14 may be withdrawn from the die 11 but be so securely swaged onto the tip of the extrusion pin 33 that it is not removed by the punch 34 acting as a stripper. This condition is illustrated in FIG. 8. In either case damage will occur on the next cycle of operation of the machine due to the attempted insertion of two workpieces in the die.

One way of attempting to overcome this problem which has been tried is to make the spring 26 and spring 41 stronger, so that they do not allow the jammed workpiece to remain wedged in the die or swaged onto the extrusion pin. However this does not solve the problem, since this mis-formed workpiece is then carried on to the next stage of the machine and causes damage at that point. In applying the present invention to the machine, the springs 26 and 41 are each weak enough to be overcome by the corresponding fault condition described above.

Both of these fault conditions are detected by making use of the fact that, in normal operation of the machine, a pin is normally movable through the bore of the tubular workpiece in the direction of retraction of the extrusion pin, after the completion of the extrusion process. In normal operation, both the carrier pin 16 and the extrusion pin 33 thus move through the bore of the workpiece.

Non-completion of the normal movement of the carrier pin 16 (from the position of FIG. 2 to the position of FIG. 3) detects the jammed die condition of FIG. 4. This abnormal movement is illustrated in FIG. 9. Since the workpiece 14 is jammed in the die and the broken-off tip of the extrusion pin 33 is jammed in the workpiece bore, the carrier pin cannot move forwards under the urging of its spring 26 but remains held back by the jammed extrusion pin tip. This abnormal movement (or strictly non-movement) of the carrier pin 16 is represented by the curve Q' in FIG. 9, at least the part thereof between point C (forward dead-centre of ram) and point F (start of ejection). The ejector is sufficiently powerful to overcome the jammed workpiece and pin-tip and force them out of the die. However if such a faulty component (with an obstructed bore) were passed to the next machine stage, damage would occur, so it is desirable to detect the fault as soon as possible, to allow for stopping of the machine before the next cycle of operation starts.

Non-completion of normal movement (from the position of FIG. 6 to the position of FIG. 7) of the extrusion pin detects the jammed extrusion pin condition of FIG. 8.

The abnormal movement is illustrated in FIG. 10. Since the extruded workpiece 14 is securely swaged onto the tip of the extrusion pin 33, the extrusion pin cannot retract with respect to the workpiece and the punch as the ram is initially retracted (which normal movement is represented by the portion C-D of curve P in FIG. 10). Insteadthe extrusion pin 33 remains locked forwards with respect to the punch 34 and ram 31, and retracts with the ram. This abnormal movement (or strictly non-movement) of the extrusion pin with respect to the workpiece and punch is represented by the part P' of the curve P in FIG. 10).

In the case of both the carrier pin and the extrusion pin, completion or non-completion of normal movement is detected electrically. It is arranged that completion of normal movement closes an electrical swtich to provide an electrical signal indicative of such completion.

The die-side switch associated with the carrier pin 16 is illustrated in FIGS. 1 to 4. The switch comprises a movable contact provided by the spring-follower cup 25, and a fixed contact provided by a brass contact ring 61 mounted outside the rear of the fixed bush 23 by an insulating bush 62. The spring follower cup is electrically connected to the machine frame via spring 26, the frame providing one side of the electrical connection. An insulated lead 63 is connected to the contact ring 61, and terminates in a suitable plug 64, from which an electrical signal can be obtained whenever the switch 25/61 is closed, i.e. whenever the carrier pin has completed its normal forwards travel.

The ram-side switch associated with the extrusion pin is illustrated in FIGS. 5 to 8. In this case the fixed contact comprises a conducting brass screw 65 screwed into an insulating disc 66 inside the front end of the plug 37. The moving contact comprises a conducting spring-follower cup 67 inside the plug urged forwardly by a spring 68, the rear end of which contacts the ram 31 and is thus electrically connected to the machine frame. A pushrod 69 extends through a hole in the centre of the insulating disc 66, through a hole in the front of the plug 37, and through a bore in the filler 38. The front end of the pushrod 69 can abut the blade 44 in the grooved collar 42. It will be seen from a comparison of FIGS. 7 and 8 that the length of the pushrod 69 is such that when the punch 34 is level with the extrusion pin 33 (as in FIGS. 5 and 7) i.e. when the extrusion pin has completed its normal travel, the spring-follower cup 67 is allowed to contact the screw head 65 under the urging of spring 68, i.e. the switch 65/67 is closed. When the extrusion pin 33 is forwards relative to the punch 34 (as in FIG. 8) i.e. when is has not completed its normal travel, the pushrod 69 is held rearwardly by the blade 44, and the spring-follower cup 67 is held away from screwhead 65 (as in FIGS. 6 and 8) i.e. the switch 65/67 remains open. An insulated lead 71 is connected to the screw 65 and is taken outside the machine. It terminates in a suitable plug 72 from which an electrical signal can be obtained when the switch 65/67 is closed i.e. when the extrusion pin 33 has completed its normal travel rearwardly with respect to the workpiece and punch.

The switches 25/61 and 65/67 each provide means for producing a signal in response to completion of normal movement of a detector pin. However, due to the vibration of the machine, the movement of the parts, and other random variations, the contacts made by the switches and liable to be intermittent and momentary, so that any resulting signal will likely be transient and/or intermittent. In order for such a signal to be read and acted on in a reliable and satisfactory manner, there is also provided in this preferred embodiment of the invention means for retaining an indication of the signal from the or each switch at least for a predetermined part of the retraction of the tool, and means for reading the retained indication at a predetermined point within the predetermined part of the retraction of the tool. These means are illustrated schematically in FIG. 11, which is a block diagram of the electrical logic circuitry involved.

Figure 11:
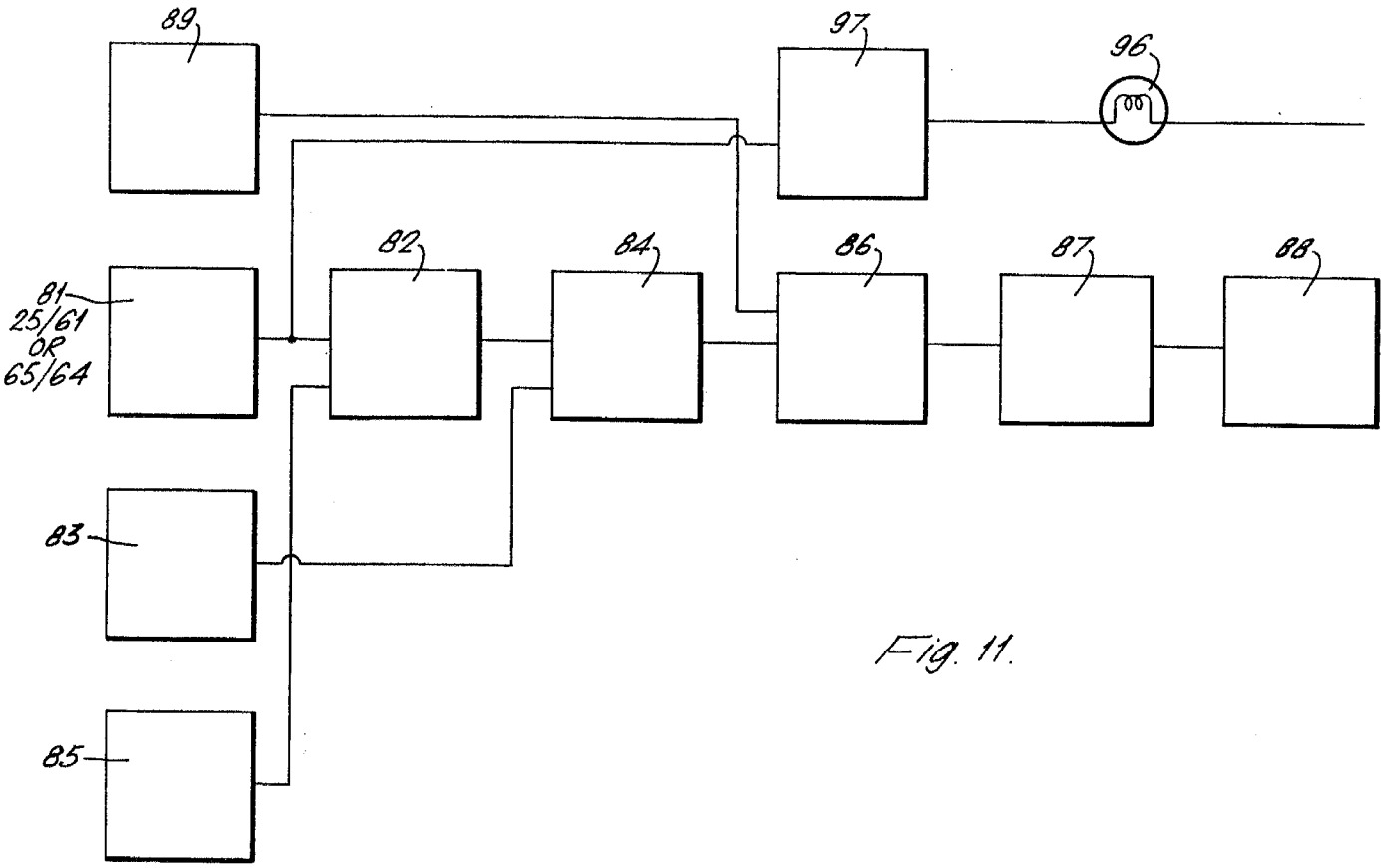
FIG. 11 is a block diagram illustrating the electrical circuitry of the fault detector.

Switch 81 in FIG. 11 is provided by either switch 25/61 or 65/67, closure of the switch providing at least one pulse, due to the application of a suitable electrical potential (relative to the electrical circuitry) to the machine frame. The output from the switch is fed to a flip-flop 82 which is set to "on" by the incoming switch pulse. At a predetermined point, after the swtich will have been closed if its associated detector pin has completed its normal travel, the condition of the flip-flop is read, by means of a "read" pulse generated by generator 83 and fed to comparator 84. The latter there upon compares the condition of flip-flop 82, as indicated by its output, with the pulse from the generator 83. If there is an output from the flip-flop 82, i.e. if it is "on", there is no output from the comparator 84, and nothing further is actuated. At an appropriate later point in the machine cycle a reset pulse generated by a reset pulse generator 85 resets the flip-flop 82 to "off", ready for the next cycle of the machine.

If there is a fault condition detected by the switch 81, the switch will not have produced an output, and the flip-flop 82 will not have been set to "on", but will remain "off" by the time the "read" pulse is generated. There will then be an output from the comparator 84, and this energises a fault latch 86 which locks on. This is turn energises an output relay 87 which actuates switch gear 88 which shuts off power to the motor driving the machine and also applies brakes to the machine crankshaft, in order to stop the machine as soon as possible and before the next cycle of operation starts, to avoid damage to the machine. After the fault has been rectified, a fault reset switch 89 is used to reset the fault latch 86 and relay 87.

In FIGS. 9 and 10, the point X indicates the point at which the conditions of both fault detector switches 25/61 and 65/67 are read. The point X is necessarily later than the point E, which represents completion of normal movement of the carrier pin 16 (and which is later than completion of normal movement of the extrusion pin represented by point S in FIG. 10).

However the part of the cycle elapsed between point E and point X is very much less than the part of the cycle elapsed between point X (reading) and point F (start of ejection). That is, the fault conditions are read as soon as practically possible and as long before the start of ejection as possible.

Figure 12:
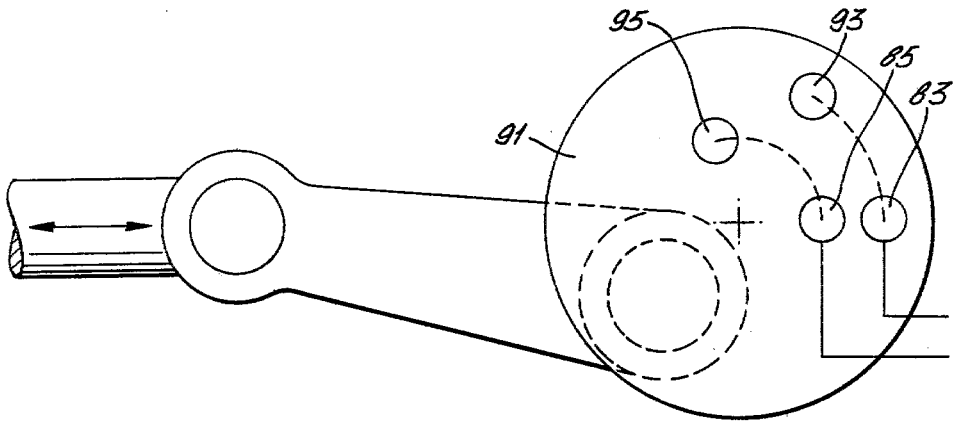
FIG. 12 illustrates schematically the timing device for determining inter alia the aforesaid predetermined reading point.

FIG. 12 illustrates the means used to provide the "read" pulse generator 83 and the "reset" pulse generator 85. Each of these comprises a proximity sensor mounted adjacent a disc 91 on the machine crankshaft. Each proximity sensor 83, 85 overlies the path of a metallic protrusion 93, 95 respectively on the disc. The angular relationship between the protrusions 93, 95, and the machine crankshaft is such that, during each cycle of the machine, each protrusion passes its associated sensor at the appropriate point to generate the appropriate pulse.

In addition to the logic circuit which monitors the contacting of the spring follower 25 with the brass contact ring 61 to provide a signal to continue running of the machine, there is also provided a fail safe circuit which will detect a false safe indication from the switch. Such a false safe indication may arise if the circuit is closed by any means other than the meeting of the spring follower 25 with the contact 61. Such a closure of the circuit may be caused, for example, by swarf accumulating in a position such that a short circuit is formed between the brass contact ring 61 and the machine frame, or by a breakdown of the insulation around the conductor 63.

The fail safe circuit is arranged to monitor the opening of the circuit which normally occurs when the spring follower 25 loses contact with the brass contact ring 61.

In this embodiment the fail safe circuit comprises a visual indicator in the form of a lamp 96 which is arranged to light when the switch 25/61 is open and to be unlit when the switch 25/61 is closed. This is achieved through an amplifier 97 which operates in response to the relatively low current signal appearing at switch 25/61 (i.e. switch 81 in FIG. 11). It will therefore be appreciated that during normal running of the machine the lamp will flash once in each cycle. However, in the event of either the lamp failing or a short circuit occurring the lamp will remain permanently off, and in the event that an open circuit occurs, caused for example by the spring follower failing to complete the circuit comsequent upon jamming of the spring follower or breaking of the spring 26, the lamp will remain permanently on. As the logic circuit already monitors the open circuit condition, the failure of the lamp to light will provide a visual indication that a short circuit may have occurred, and requires investigation.

It will also be appreciated that instead of a merely visual indication of a fault in the switch, the logic circuit can be arranged to switch off the machine in the event that a short circuit occurs.

Similar fail safe short circuit protection is also provided for switch 65/67.

In practice, each fault detector switch 81 on the macine has associated with it its own circuit comprising components 82, 84, 86, 87, 89, 96 and 97. Common generators 83 and 85 feed all circuits. Fault detectors may be provided on more than one stage of the machine.

The invention is not restricted to the details of the foregoing example.

We claim:

1. A fault detector for a metal-forming machine for producing a tubular workpiece which machine is of the type comprising a fixed die which receives the workpiece;

a movable tool reciprocable in repeated cycles andmovable towards the die to act on the workpiece from the die;

which movable tool includes a metal-forming pin which is first advanced towards the die and into the workpiece, which machine includes means compressing the workpiece around the metal-forming pin so as to form a bore through the tubular workpiece, and which movable tool is subsequently retracted from the die in a direction opposite to the said direction of advance to provide for removal of the workpiece therefrom;

which fault detector comprises:

a detector pin mounted for axial movement along the axis of reciprocation of the said metal-forming pin and normally movable through the bore of the tubular workpiece, after the completion of the compression process, in the direction of retraction of the metal-forming pin; and fault indicating means responsive to completion or noncompletion of normal movement of the detector pin for producing a signal indicating a fault if the detector pin has not moved normally through the workpiece bore as aforesaid.

2. A fault detector as claimed in claim 1, in which the detecot pin is located mounted behind and/or within the die and is normally movable through the bore of the tubular workpiece as aforesaid by movement into and/or through within the die.

3. A fault detector as claimed in claim 1, in which the detector pin is provided by the aforesaid metal-forming pin;

the movable tool includes another part, other than the metal-forming pin, which other part abuts the workpiece in use of the tool;

and in which the pin is normally movable through the bore of the tubular workpiece as aforesaid by relative movement between the pin and the said other part of the movable tool abutting the workpiece.

4. A fault detector as claimed in claim 1, in which the movable tool includes another part, other than the metal-forming pin, which other part abuts the workpiece in use of the tool; which machine includes a first detector pin mounted behind the die and is normally movable through the bore of the tubulasr workpiece as aforesaid by movement within the die, and a second detector pin provided by the aforesaid metal-forming pin which is normally movable through the bore of the tubular workpiece as aforesaid by relative movement between the pin and the said other part of the movable tool abutting the workpiece.

5. A fault detector as claimed in claim 2, which machine includes a guide pin which guides the workpiece during its removal from the die and in which the detector pin or the first detector pin is provided by the said guide pin.

6. A fault detector as claimed in claim 3 or claim 4, in which the said other part of the tool is a punch or stripper surrounding the pin.

7. A fault detector as claimed in any of claims 1 through 4, in which normal movement of the or each detector pin is completed before the start of removal of the workpiece from the die.

8. A fault detector as claimed in any of claims 1 through 4, in which said fault indicating means responsive to completion or non-completion of normal movement of the or each detector pin comprises:

first means for producint a first signal in response to completion of the normal movement of the or each detector pin;

second means for retaining an indication of said first signal at least for a predetermined part of the retraction of the tool;

and third means for reading the said retained indication at a determined point within said predetermined part of the retraction of tool.

9. A fault detector as claimed in claim 8, for a metal-forming machine of the type defined which machine includes an ejector for ejecting the tubular workpiece from the die after completion of the compression process, in which fault detector the aforesaid predetermined reading point at which the signal is read is before the start of ejection of the workpiece.

10. A fault detector as claimed in claim 9, in which the aforesaid predetermined point at which the signal is read is such that the extent of the part of the retraction of the tool which elapses between the end of normal movement of the detector pin through the tubular workpiece and the aforesaid predetermined reading point is substantially less than the extent of the part of the retraction of the tool which elapses between the aforesaid predetermined reading point and the start of ejection of the workpiece.

* * * * *

UNITED STATES PATENT AND TRADEMARK OFFICE

CERTIFICATE OF CORRECTION

PATENT NO. : 4,202,191

DATED : MAY 13, 1980

INVENTOR(S) : EDWARD A. SKINNER

It is certified that error appears in the above—identified patent and that said Letters Patent is hereby corrected as shown below:

Column 9, between lines 42 and 43, insert "and retractable away from the die to provide for removal of the workpiece".

Signed and Sealed this

First Day of December 19

[SEAL]

Attest:

GERALD J. MOSSINGHOFF

Attesting Officer

Commissioner of Patents and Trademarks